US008245741B2

(12) United States Patent
Filion et al.

(10) Patent No.: US 8,245,741 B2
(45) Date of Patent: Aug. 21, 2012

(54) METHOD AND SYSTEM FOR GLULAM BEAMS

(75) Inventors: Lucien Filion, Chibougamau (CA); Emilien Racine, Chibougamau (CA)

(73) Assignee: Les Chantiers Chibougamau Ltee, Chibougamau, Quebec (CA)

( * ) Notice: Subject to any disclaimer, the term of this patent is extended or adjusted under 35 U.S.C. 154(b) by 324 days.

(21) Appl. No.: 12/100,015

(22) Filed: Apr. 9, 2008

(65) Prior Publication Data

US 2009/0255605 A1 Oct. 15, 2009

(51) Int. Cl.
*B27D 1/00* (2006.01)
*B27G 11/00* (2006.01)

(52) U.S. Cl. ..... 144/346; 144/348; 144/350

(58) Field of Classification Search ..... 144/2.1, 144/381, 344–355
See application file for complete search history.

(56) References Cited

U.S. PATENT DOCUMENTS

| | | | | | |
|---|---|---|---|---|---|
| 2,389,944 | A | * | 11/1945 | Winkel | 156/222 |
| 2,490,819 | A | * | 12/1949 | Lambert et al. | 156/300 |
| 3,046,181 | A | * | 7/1962 | Mann et al. | 156/274.6 |
| 3,215,065 | A | * | 11/1965 | Malarkey, Jr. | 100/327 |
| 3,990,937 | A | * | 11/1976 | Knowles | 156/558 |
| 4,101,370 | A | * | 7/1978 | Russell | 156/555 |
| 4,128,119 | A | * | 12/1978 | Maier | 144/347 |
| 4,314,871 | A | * | 2/1982 | Weinstock et al. | 156/258 |
| 4,356,045 | A | * | 10/1982 | Elford et al. | 156/64 |
| 4,711,281 | A | * | 12/1987 | Kessel et al. | 144/256.1 |
| 5,050,653 | A | * | 9/1991 | Brown | 144/351 |
| 5,141,582 | A | * | 8/1992 | Scott | 156/256 |
| 5,313,758 | A | * | 5/1994 | Willman et al. | 52/415 |
| 5,352,317 | A | * | 10/1994 | Traben et al. | 156/254 |
| 5,888,620 | A | | 3/1999 | Grenier | |
| 6,007,677 | A | * | 12/1999 | Skuse | 156/380.2 |
| 6,025,053 | A | * | 2/2000 | Grenier | 428/172 |
| 6,162,312 | A | * | 12/2000 | Abney | 156/154 |
| 6,279,629 | B1 | * | 8/2001 | Sing | 144/347 |
| 6,446,412 | B2 | * | 9/2002 | Mathis | 52/847 |
| 6,701,984 | B2 | * | 3/2004 | Lamontagne et al. | 144/347 |
| 6,878,230 | B2 | * | 4/2005 | Abe et al. | 156/304.5 |
| 6,960,277 | B2 | * | 11/2005 | Brunet | 156/264 |
| 7,240,712 | B2 | * | 7/2007 | Cable | 156/510 |
| 2004/0071914 | A1 | * | 4/2004 | Fiutak et al. | 428/40.1 |
| 2006/0011266 | A1 | * | 1/2006 | Holzhey | 144/347 |
| 2007/0157994 | A1 | * | 7/2007 | Scoville et al. | 144/380 |
| 2008/0003395 | A1 | * | 1/2008 | Cui et al. | 428/57 |

FOREIGN PATENT DOCUMENTS

CA 1265031 1/1990

OTHER PUBLICATIONS

"CPR 3000." Product Description. 2005. Conception R.P. Inc. Accessed Jun. 29, 2012. http://web.archive.org/web/20060313093214/http://www.conceptionrp.com/en/index.php?page=crp3000.

* cited by examiner

*Primary Examiner* — David Walczak
*Assistant Examiner* — Jennifer C Chiang
(74) *Attorney, Agent, or Firm* — Quarles & Brady LLP

(57) ABSTRACT

A method and a system for glulams fabrication, comprising obtaining wood pieces of a target length from raw materials; and assembling them into structural timbers of a target thickness in a continuous line, whereby moisture content, end joints, mixing and applying of adhesives, glue line pressure and clamping time are continuously controlled.

6 Claims, 3 Drawing Sheets

METHOD AND SYSTEM FOR GLULAM BEAMS

FIELD OF THE INVENTION

The present invention relates to wood engineering. More specifically, the present invention is concerned with a glulams fabrication system and method.

BACKGROUND OF THE INVENTION

One the one hand, glued laminated timbers, also called laminated timber beams, glue-laminated beams or glulams, are structural timber products composed of several layers of dimensioned lumbers glued together. By laminating several smaller pieces of wood, a single large, strong, structural member can be manufactured from smaller timbers, for use as ridge beams, garage door headers and floor beams, vertical columns or horizontal beams, often in curved, arching shapes for example. Glulam structural members thus make use of smaller and less desirable dimensions of timber, yet are engineered to be stronger than similarly sized members comprised of solid wood. Glued laminated beams are used in a wide range of applications in both commercial and residential construction.

On the other hand, solid dimensional lumber lengths typically max out at lengths of 22' to 24', but may be made longer by the technique of "finger-jointing" lumber by using small solid pieces, usually 18" to 24" long, and joining them together using finger-joints and glue to produce lengths that can be up to 36' long in 2×6 size for example.

There is still a need in the art for a method and a system for fabricating glulam beams.

SUMMARY OF THE INVENTION

More specifically, there is provided a method for glulams fabrication, comprising obtaining wood pieces of a target length from raw materials; and assembling the wood pieces of the target length into structural timbers of a target thickness; in a continuous line at a rate of up to 500-600 linear feet/minute, whereby moisture content, end joints, mixing and applying of adhesives, glue line pressure and clamping time are continuously controlled.

There is further provided a system for fabrication of glulams, comprising a finger-jointing unit providing wood pieces of a target length; and a beam forming unit; wherein the wood pieces of the target length produced by the finger-jointing unit are directly processed by the beam forming unit into glulams.

Other objects, advantages and features of the present invention will become more apparent upon reading of the following non-restrictive description of embodiments thereof, given by way of example only with reference to the accompanying drawings.

DESCRIPTION OF EMBODIMENTS OF THE INVENTION

Figure 1:
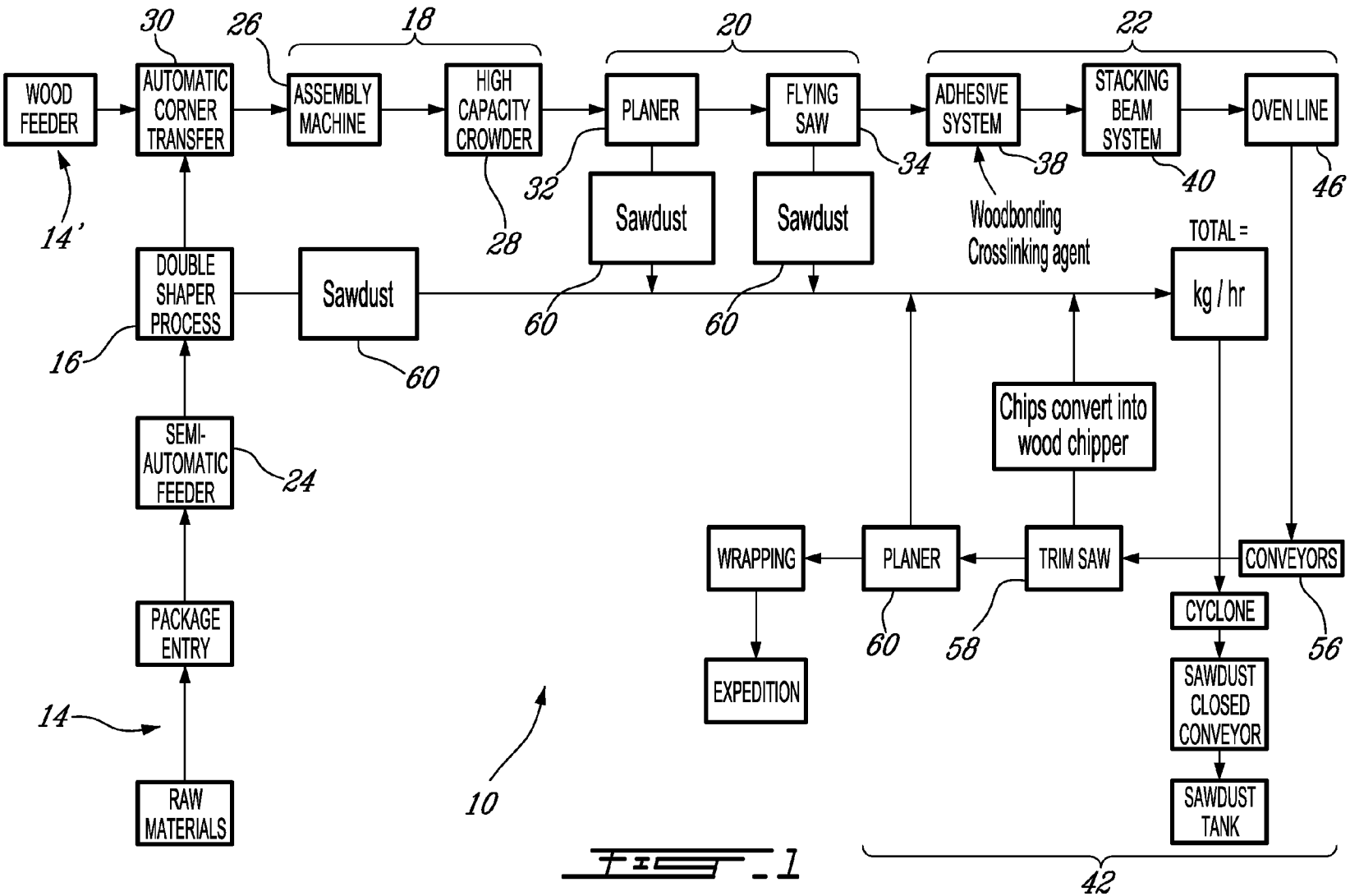
FIG. 1 is a flowchart of a system according to an embodiment of an aspect of the present invention.
Figure 2:
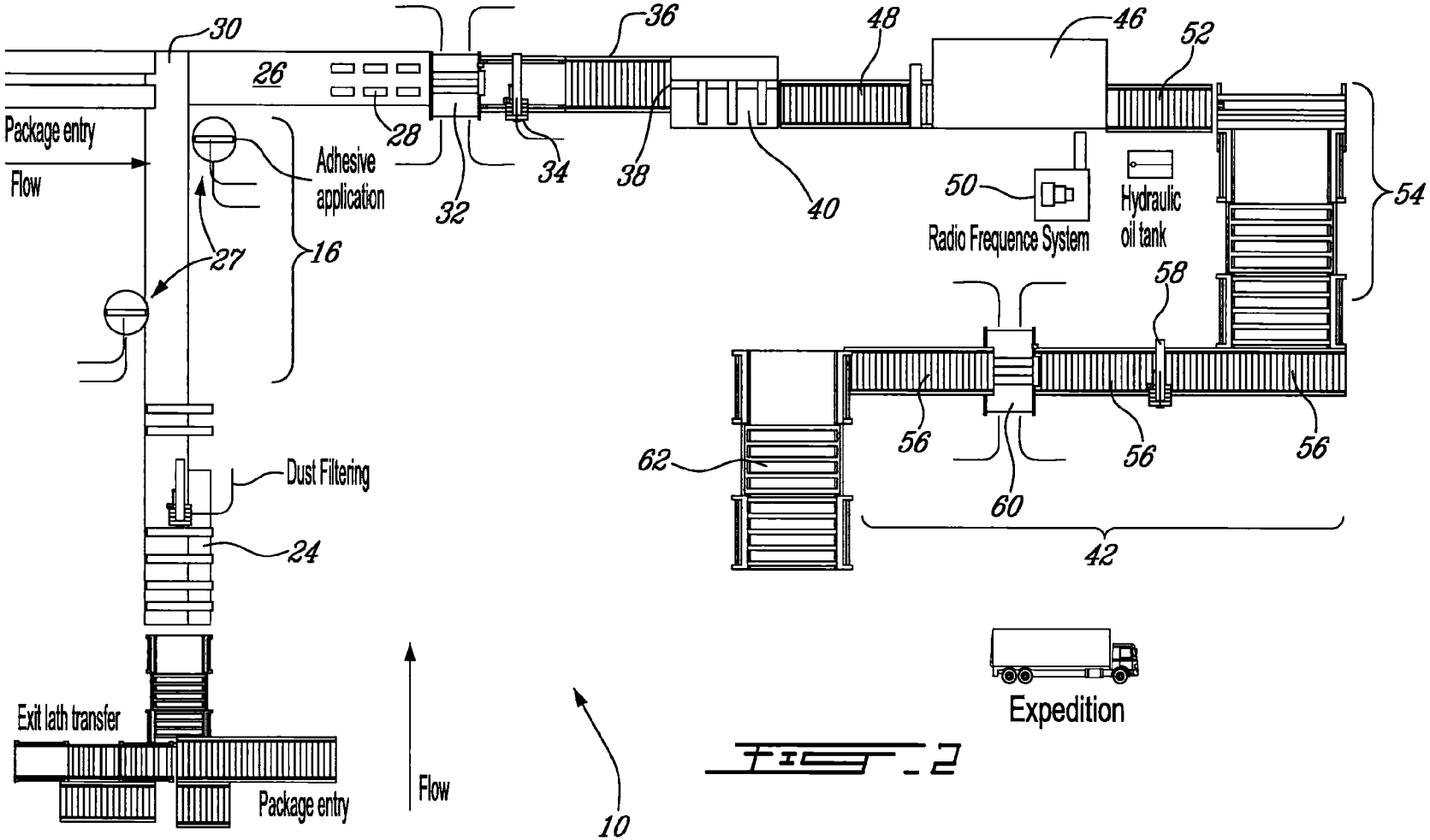
FIG. 2 is a schematical view of the system of FIG. 1.
Figure 3:
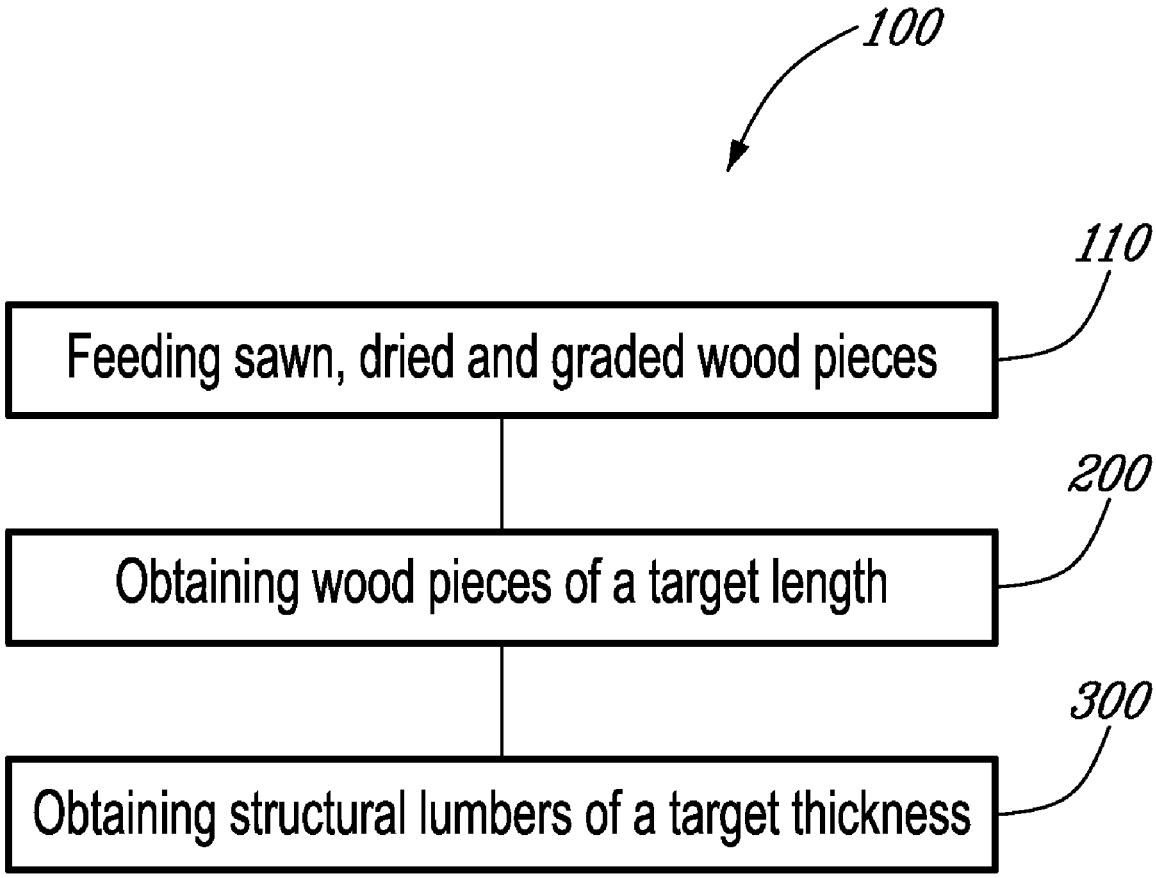
FIG. 3 is a flowchart of a method according to an embodiment of another aspect of the present invention.

A system 10 according to an embodiment of the present invention will be described in relation to FIGS. 1 and 2.

The system 10 generally comprises a finger jointing unit and a beam-forming unit 22.

A raw material reception station 14 is provided for reception of raw materials, i.e. sawn, dried and graded wood pieces. A feeder 24 is used to provide the wood pieces to the finger jointing unit, at a rate of about 180 lugs/minute and adjustable by a variable frequency drive (see FIG. 2).

The finger-jointing unit includes a joint machining station 16, a joint insertion station 18 and a sizing station 20.

The joint machining station 16 comprises a double shaper for joint machining and glue application inside the joints. The glue is injected using a glue applicator, from an adhesive tank 27 (see FIG. 2, for example). Up to 180 lugs may be processed by minute, at a rate adjustable by a variable frequency drive, including dynamic braking.

An automatic transfer 30 transfers the wood pieces with their glued joints from the double shaper 16 to the joint insertion station 18, at a rate of up to 180 lugs/minute adjustable by a variable frequency drive.

The joint insertion station 18 comprises an assembly machine 26 for inserting the joints one by one, and a high capacity crowder 28 used to apply pressure.

The sizing station 20 comprises a planer 32 and a flying saw 34. The planer 32 is for planning or surfacing the joint wood pieces by means of a rapidly revolving cutter, which chips off the rough surface in many shavings. The wood pieces are passed over or under the revolving cutter by power feed, leaving a smooth or finished surface, thereby ensuring ensure clean and parallel surfaces before gluing. The planer thus surfaces the wood pieces and reduces them to a uniform thickness, at a rate between 100 and 600 feet per minute. The flying saw 34 allows cutting the pieces of wood to predetermined lengths from the continuously incoming joint-ended pieces of wood, at a rate of up to 400' (120 m) per minute.

The beam forming unit 22 comprises a conveyer feeder 36, an adhesive distribution system 38 for application of adhesive on the surfaces of the joint-ended pieces of wood, a stacking beam system 40 for assembling the thus adhesive-covered joint-ended pieces of wood into a pre-determined lay-up pattern, and an oven 46 for adhesive hardening. The oven 46 comprises a conveyer oven entry 48, a lamination oven 50 using radio technology and a hydraulic system for applying pressure, an exit conveyer 52, and a beam recovery system and beam accumulation transfer means 54, as detailed in FIG. 2 for example.

It is to be noted that raw material consisting of laminations for example, may be fed from a second raw material entry 14' (see FIG. 1), and directly processed by the beam forming 22.

Then, a finishing station 42 typically comprises conveyers 56, a precision end trim saw 58 for trimming, a planer 60 for commercial sizing of the four faces, and an exit transfer 62.

Tables 1 and 2 below give examples of raw materials used and finished products (i.e. structural glue laminated beams) obtained, respectively, for reference).

TABLE 1

| | AFTER DRYING | | |
|---|---|---|---|
| SIZE | Thickness (") | Width (") | Pieces/ package |
| 1 × 3 | 1.173 | 2.653 | 594 |
| 1 × 4 | 1.174 | 3.613 | 432 |
| 2 × 3 | 1.647 | 2.692 | 418 |
| 2 × 2 | 1.732 | 2.231 | 494 |
| 2 × 4 | 1.630 | 3.664 | 304 |
| 2 × 6 | 1.660 | 5.700 | 160 |
| 2 × 8 | 1.660 | 6.700 | 160 |

TABLE 2

| Products | Dimensions |
|---|---|
| Length | 8' to 52' |
| Width | 1¾" to 7½" |
| Height | 3½" to 30" |

Dust collecting units 60 are distributed along the line, so as to collect saw dust that would otherwise contaminate the system and be harmful for the workers around.

the end-jointed lumbers have been planed into boards, flanges are cut by a flying saw to obtain desired lengths.

It is to be noted that there is no need for a drying step between steps 200 and 300. Moreover, there is no need to perform continuous traction tests on the end-jointed lumbers.

In step 300, a high quality permanent adhesive is spread onto the end-joint boards with a glue extruder. A crosslinking agent such as CX-47 and woodbonding resin such as WD3-A322 for example are used. Table 3 below shows characteristics of adhesives and cross-linking agents that may be used.

TABLE 3

| Adhesive name | Appearance | Solids (%) | Viscosity Brookfield, cps | Spindle | Specific Gravity | PH at 25° C. | Flash Point ° F. | Pounds per gallon | Freeze thaw Stability |
|---|---|---|---|---|---|---|---|---|---|
| WD3-A322 Woodbonding adhesive resin | White, opaque fluid | 53.5-57.0 | 1000-2000 | N° 4 @ 10 rpm. 25° C. = 3000-6000 | 1.09 | 4.5-6.0 | >200 | 9.1 | Yes |
| CX-47 Cross Linking agent | White, opaque fluid | 43.0-46.0 | 4500-6000 | N° 4 @ 10 rpm. 25° C. | 1.15-1.25 | 6.0-7.0 | >200 | 10 | None |
| UX-100 Polyurethane polymer adhesive | Amber Viscous liquid | 100% Solvent free | — | N° 4 @ 10 rpm. 25° C. = 3,000-6,000 | 1.10-1.20 | — | 460 | 9.3-10.0 | — |

A method 100 according to an embodiment of a further aspect of the present invention generally comprises feeding sawn, dried and graded wood pieces (110), obtaining wood pieces of a target length (step 200); and assembling them to yield structural timbers of a target thickness (step 300), in a continuous line.

Species of wood used have known structural capacity, such as black spruce of a density of about 28.04 and jack pine of a density of about 24.92 for example, which are resistant softwoods. The raw lumbers are sawn, dried and graded. The moisture content of the pieces of wood is determined with a meter that checks the moisture thereof prior to adhesive application on the pieces of wood.

Generally, the moisture content of the wood pieces is to be below 16% at the time of bonding, except when it is known that the equilibrium moisture content of the final product in use is 16% or more. In such case, the moisture content of the wood pieces at the time of bonding may be up to 20%. Wood pieces with moisture content greater than the given threshold (such as 20% for example) are re-dried, through air-drying or kiln drying for example. The average range of moisture content of the resulting finished beams shall not exceed 5%.

Moisture content of a finished timber is based on the average content of the cross section thereof whereas the moisture content of a wood piece to be layered is based on the average moisture content along its length.

In step 200, the sawn, dried and graded lumbers are finger-jointed (end-jointed) together using finger-joints and glue to produce wood pieces of a target length, which is the length of the finished glulam, generally greater than the length commonly available from as-sawn lumbers. The lumbers are thus joined to produce longer lengths, which are then machined on both ends with a shaper such as a cutter head. A structural resin is applied and the joints are mated. A polyurethane adhesive with a woodbonding resin, such as a mix UX-100/WD3-A322 for example, may be used. The resin is cured with the joint under pressure in an assembly machine 26 and crowder 28. The end-jointed wood pieces are planed on both sides to yield boards with clean, parallel surfaces for gluing. Once The end-joint boards, once thus resin coated, are clamped together into a pre-determined lay-up pattern inside a stacking beam system by a hydraulic system inside a radio frequency oven, so that the stacked boards are submitted to heat and pressure. Pressure is to be maintained during a period of time sufficient to ensure close contact between the boards while not over-stressing glue-lines during the development of the bond strength. The average cooking time may be comprised between 3 and 7 minutes per section of 16 feet wood pieces, at a temperature between 149 and 194° F. (i.e. between 65 and 90° C.) and under a pressure comprised between 1100 and 1500 psi (i.e. between 7584 and 10 342 kPa). After the resulting timbers are removed from the oven by the hydraulic system, their wide faces (sides) may be planed or sanded to remove beads of resin that may have squeezed out between the boards. Their narrow faces (top and bottom) may be lightly planed or sanded depending on appearance requirements. Their edges (corners) may be squared (90 degrees). The specified appearance of the desired timbers dictates whether additional finishing is required at this point. For example, knotholes may be filled with putty patches and the timbers may be further sanded. End sealers may be further applied to the timbers. Then, the finished timbers are wrapped, attached and shipped.

There is therefore provided a continuous system and method for producing glulams, at a rate of up to 500-600 linear feet/minute, in a single line, wherein moisture content, end joints, mixing and applying of adhesives, glue line pressure and clamping time are continuously controlled to turn low value logs into high grade lumber, at a competitive cost.

An average time duration from the raw material to the glulams is about 15 to 20 minutes since the jointed boards go directly to the stacking and gluing step, whereas in the case of standards installations where jointing and stacking are made in different lines, due to the need of transfer, transient storage and intermediate glue drying, the process may take about 12 hours. Such a reduced time allows a tighter control of glue adhesion for example, and yields an increased quality of the end products.

Since the glulams are made from smaller pieces of wood, which can easily be bent, curved glulam beams may be fabricated.

The finished timbers are structural glue laminated beams have increased strength capabilities compared with the starting products, and meet high quality standards, in terms of shearing resistance, delamination resistance, fire resistance, dimensional stability and traction properties.

Glulam of the present invention may be used in a range of structures for architectural and structural purposes, including domestic construction, recreational buildings, industrial strictures requiring large column free spaces, and other structural uses.

Although the present invention has been described hereinabove by way of embodiments thereof, it may be modified, without departing from the nature and teachings of the subject invention as defined in the appended claims.

What is claimed is:

1. A method for continuous glulams fabrication from small pieces of wood in a single line, comprising:

using a finger-jointing unit, finger-jointing small pieces of wood of a thickness of at most 2 inches into wood pieces of a target length;

surfacing the wood pieces of the target length, at a rate between about 100 and 600 feet per minute, cutting the wood pieces to predetermined lengths at a rate of up to about 400 feet per minute; and directly laying-up the wood pieces and forming into structural timbers of a target thickness from about 3.5 inches up to about 30 inches and of the target length, in a continuous line at a rate of up to about 500-600 linear feet/minute;

wherein said step of finger-jointing comprises joint machining at least one joint of the small pieces of wood and applying glue inside the at least one joint, joint inserting the resulting machined preglued wood pieces, and sizing the resulting wood pieces of the target length; and wherein said finger-jointing unit comprises a joint machining station, a joint insertion station and a sizing station, said sizing station leading to a beam forming unit.

2. The method of claim 1, wherein said step of directly laying up the wood pieces into structural timbers comprises applying adhesive on surfaces of the wood pieces, stacking the resulting adhesive-covered wood pieces into a pre-determined lay-up pattern and submitting them to heat and pressure in an oven.

3. The method of claim 2, wherein said step of submitting to heat and pressure comprises a cooking time between 3 and 7 minutes per section of 16 feet wood pieces, at a temperature between 149 and 194° F. under a pressure comprised between 1100 and 1500 psi.

4. The method of claim 1, comprising feeding the small pieces of wood to said finger-jointing step at a rate of about 180 lugs/minute.

5. The method of claim 1, wherein said step of joint machining and application of glue inside the at least one joint is performed at a rate of up to 180 lugs per minute and the resulting machined preglued wood pieces proceed to said step of joint inserting at a rate of up to 180 lugs per minute.

6. The method of claim 1, further comprising bending the structural timbers into curved glulam beams.

* * * * *